United States Patent [19]

Shimizu

[11] 4,428,330

[45] Jan. 31, 1984

[54] PISTON FOR INTERNAL COMBUSTION ENGINES

[75] Inventor: Yoshiaki Shimizu, Fujisawa, Japan

[73] Assignee: Kabushiki Kaisha Komatsu Saisakusho, Tokyo, Japan

[21] Appl. No.: 415,819

[22] Filed: Sep. 8, 1982

[51] Int. Cl.[3] ..... F01P 3/10

[52] U.S. Cl. ..... 123/41.35; 92/186

[58] Field of Search ..... 123/41.35; 92/186, 238

[56] References Cited

U.S. PATENT DOCUMENTS

| | | | |
|---|---|---|---|
| 2,865,348 | 12/1958 | Kramer et al. | 123/41.35 |
| 3,703,126 | 11/1972 | Haug | 123/41.35 |
| 4,011,797 | 3/1977 | Cornet | 92/186 |
| 4,206,726 | 6/1980 | Johnson, Jr. et al. | 123/41.35 |
| 4,331,107 | 5/1982 | Bruni | 123/41.35 |
| 4,359,973 | 11/1982 | Shimada | 123/41.35 |

*Primary Examiner*—William A. Cuchlinski, Jr.
*Attorney, Agent, or Firm*—Armstrong, Nikaido, Marmelstein & Kubovcik

[57] ABSTRACT

A cast iron piston for an internal combustion engine with oil cooling of the head of the piston and comprising an annular cooling chamber located in the piston head in proximity at least to the groove of the first piston ring.

Bottom wall of the annular cooling chamber is inclined uniformly inwards from top to bottom and having formed therein a plurality of casting holes one of which serves for an oil inlet port and the other for oil outlet ports.

2 Claims, 3 Drawing Figures

PISTON FOR INTERNAL COMBUSTION ENGINES

BACKGROUND OF THE INVENTION

This invention relates to an oil-cooled piston for internal combustion engines and in particular, to an oil-cooled piston cast in one piece from a cast iron.

It is well known from experience that in heavily stressed engines, the temperature in the top ring groove must not exceed from 180° to 200° C., since otherwise, irrespective of the operational system of the engine, ordinary commercial lubricating oils are likely to evaperate and deposit residues in the piston ring grooves, thus preventing the correct functioning of the same. It is also known that the viscosity of a lubricating oil at 200° C. is so low that it no longer forms an effective lubricating film. Therefore, it is necessary to provide the most effective cooling for the top compression rings in the case of high-stressed plunger pistons.

There have been proposed many kinds of pistons having different piston head structures with cooling chambers formed behind the ring sections of the pistons. Coolent is introduced into the cooling chamber through either the conduit or passage formed in the web section suspending pin bosses from the piston head. Since in the conventional piston passage is formed in the web by machining, the web must be thick enough for the passage to be formed therein, thus resulting in heavy piston which is harmful to piston efficiency and also passage machining itself is time consuming.

SUMMARY OF THE INVENTION

It is therefore an object of the present invention to provide a cast iron piston for an internal combustion engine which overcomes the above noted problems of the prior art and provides an improvement in cooling efficiency of the piston head.

Another object of the present invention is to provide a cast iron piston for an internal combustion engine which can improve structural strength of the piston without increasing weight thereof.

In accordance with an aspect of the present invention, there is provided an oil cooled piston cast in one piece from cast iron for an internal combustion engine, comprising: a head portion having a transverse top end crown wall, a combustion chamber defining wall and a side wall formed with ring-receiving grooves; a hollow open ended skirt portion depending from said head portion; a pair of transversely spaced bushing-like pin bearing bosses located inside of said skirt portion in symmetrical relation to a plane passing through the longitudinal axis of the piston; a pair of spaced longitudinal webs depending from said top end wall in parallel symmetrical relation to the piston axis and being connected to the tops of said pin bearing bosses for supporting same; and a substantially annular cooling oil chamber provided in said head portion in coaxial relation thereto and adjacent to said top end wall and to at least first ring-receiving groove, said chamber being bounded by said top end wall, said side wall and said combustion chamber defining wall whereas upper portion of each longitudinal web forms a bottom wall of said cooling oil chamber, said bottom wall being generally inclined uniformly inwards from top to bottom and having formed therein a plurality of casting holes one of which serves for an oil inlet port and the other for oil outlet ports.

The above and other objects, features and advantages of the present invention will be readily apparent from the following description taken in conjunction with the accompanying drawings.

DESCRIPTION OF THE PREFERRED EMBODIMENT

Figure 1:
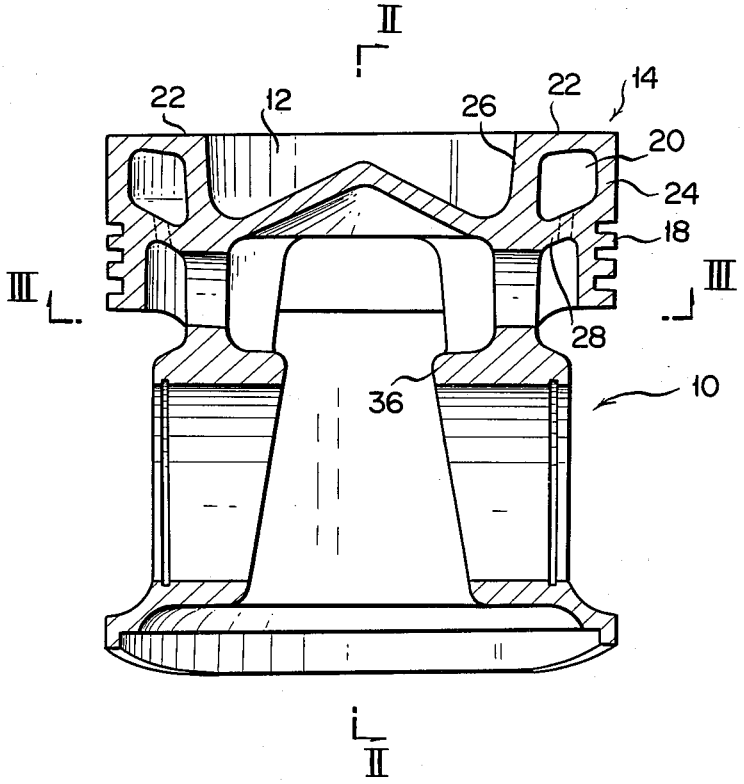
FIG. 1 is a longitudinal axial sectional view, upon the line I—I of FIG. 2 of a piston according to the present invention.

The present invention will now be described in detail below with reference to the accomanying drawings.

In the drawings, reference numeral 10 denotes a piston moulded in one piece from cast iron. The piston 10 has a combustion chamber 12 formed in the piston head 14 thereof. The piston also has a cylindrical skirt 16 with a ring section 18 formed at an upper portion thereof. An annular cooling chamber 20 is provided in the piston head 14 surrounding the combustion chamber 12. The annular cooling chamber 20 is defined on its upper and radially outer sides by a crown wall 22 and a skirt wall 24, respectively. Radially inner side of the chamber 20 is defined by a side wall 26 of the combustion chamber 12.

A bottom wall 28 of the cooling chamber 20 is generally inclined uniformly inwards from top to bottom and having formed therein a plurality of, for example four in this embodiment, casting holes 30. The angle of inclination of the bottom wall 28 is about 25° to about 40° relative to a plane perpendicular to the longitudinal axis of the piston. The casting holes 30 formed in the bottom wall 28 are holes for taking out core sand after forming the cooling chamber 20 thereby.

Figure 2:
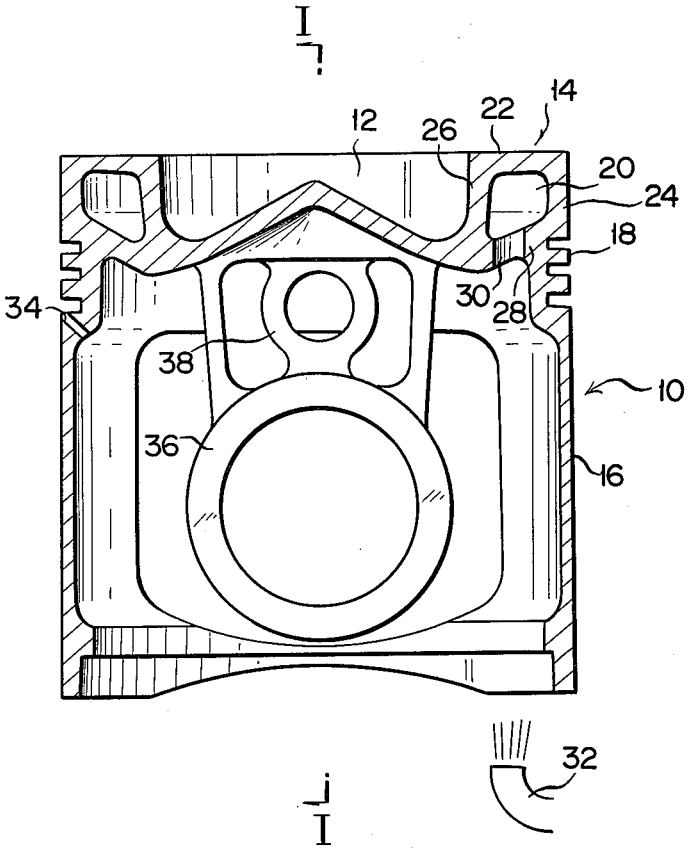
FIG. 2 is a similar sectional view upon the line II—II of FIG. 1.
Figure 3:
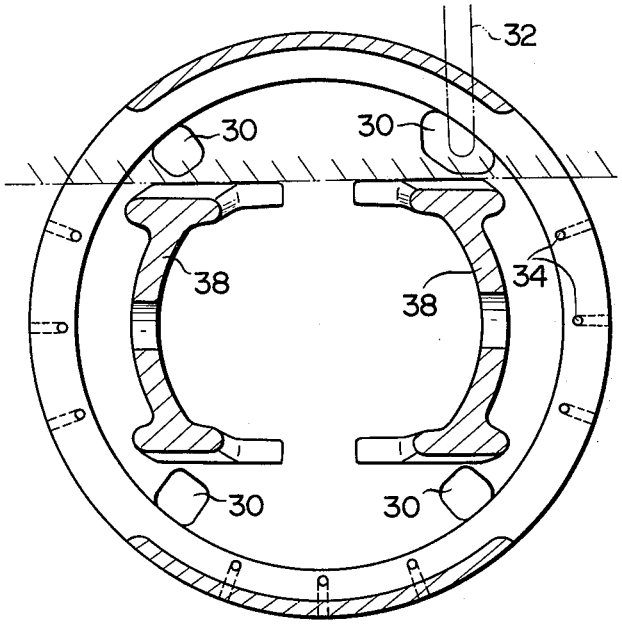
FIG. 3 is a lateral sectional view upon the line III—III of FIG. 1.

One of these casting holes 30 is utilized for inlet port of cooling oil into the cooling chamber 20 and the other holes 30 are utilized for outlet ports of the cooling oil from the chamber 20. A cooling oil injection nozzle 32 is mounted under the inlet port 30 as shown in FIGS. 2 and 3.

A plurality of oil return holes 34 are formed in the skirt 16 immediately below the ring section 18 spaced apart circumferentially except the region adjacent to the injection nozzle 32 or the cooling oil inlet port (shaded area shown in FIG. 3).

Pin boss 36 forming the bearing for the connecting rod small end is made in two portions, respectively a right portion and a left portion (FIG. 1) which are suspended from the piston head 14 by means of webs 38 which are at least approximately parallel with the longitudinal axis of the piston and are connected at the upper ends thereof with the bottom wall 28 of the annular cooling chamber 20 and the side wall 26 of the combustion chamber 12.

Since the piston of the present invention is constructed as described hereinabove, cooling oil injected from the nozzle 32 is introduced through one of the casting holes 30 serving for an inlet port into the annular cooling chamber 20 and cools the piston head 14 and then is discharged from the other casting holes 30 serving for outlet ports.

Because the casting holes 30 serve for inlet and outlet ports for cooling oil, it is not necessary to make the webs 38 thick enough for allowing a cooling oil passage to be formed therein. Therefore, overall weight of the piston can be reduced and the time consuming machine working for oil passage can be eliminated.

Besides, since the bottom wall 28 of the cooling chamber 20 is inclined inwards from the top to bottom, it is possible to reduce stress concentration in the piston head 14 thereby effectively preventing cracks from being formed in the piston head. Since in the preferred embodiment the oil return holes 34 are formed circumferentially in the skirt 16 except in the region adjacent to the nozzle 32, there is no possibility for the cooling oil injected from the nozzle 32 to leak out of the piston through the oil return holes 34. Therefore cooling oil consumption rate can be reduced.

What is claimed is:

1. An oil cooled piston cast in one piece from cast iron for an internal combustion engine, comprising:

a head portion having a transverse top end crown wall, a combustion chamber defining wall and a side wall formed with ring-receiving grooves;

a hollow open ended skirt portion depending from said head portion;

a pair of transversely spaced bushing-like pin bearing bosses located inside of said skirt portion in symmetrical relation to a plane passing through the longitudinal axis of the piston;

a pair of spaced longitudinal webs depending from said top end wall in parallel symmetrical relation to the piston axis and being connected to the tops of said pin bearing bosses for supporting same; and a substantially annular cooling oil chamber provided in said head portion in coaxial relation thereto and adjacent to said top end wall and to at least first ring-receiving groove, said chamber being bounded by said top end wall, said side wall and said combustion chamber defining wall whereas upper portion of each longitudinal web forms a bottom wall of said cooling oil chamber, said bottom wall being generally inclined uniformly inwards from top to bottom and having formed therein a plurality of casting holes one of which serves for an oil inlet port and the other for oil outlet ports.

2. An oil coated piston according to claim 1 wherein said bottom wall is inclined from about 25° to about 40° relative to a plane perpendicular to the longitudinal axis of the piston.

* * * * *